US010315747B1

(12) United States Patent
Jaszewski et al.

(10) Patent No.: US 10,315,747 B1
(45) Date of Patent: Jun. 11, 2019

(54) OUTBOARD MOTORS HAVING TRANSMISSIONS WITH LATERALLY OFFSET INPUT AND OUTPUT DRIVESHAFTS

(71) Applicant: Brunswick Corporation, Lake Forest, IL (US)

(72) Inventors: Wayne M. Jaszewski, Jackson, WI (US); John A. Tuchscherer, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 458 days.

(21) Appl. No.: 15/346,863

(22) Filed: Nov. 9, 2016

(51) Int. Cl.

| | |
|---|---|
| ***B63H 20/20*** | (2006.01) |
| ***B63H 23/34*** | (2006.01) |
| ***B63H 20/00*** | (2006.01) |
| ***B63H 21/14*** | (2006.01) |

(52) U.S. Cl.
CPC ..... *B63H 20/20* (2013.01); *B63H 20/002* (2013.01); *B63H 21/14* (2013.01); *B63H 23/34* (2013.01); *B63B 2758/00* (2013.01); *B63B 2770/00* (2013.01)

(58) Field of Classification Search
CPC ..... B63H 20/20; B63H 20/002; B63H 21/14; B63H 23/34
See application file for complete search history.

(56) References Cited

U.S. PATENT DOCUMENTS

| | | | |
|---|---|---|---|
| 1,619,449 | A | 3/1927 | Waters |
| 2,198,397 | A | 4/1940 | Szekely |
| 2,289,991 | A | 7/1942 | Paxman |
| 2,682,934 | A | 7/1954 | Howarth |
| 2,803,974 | A | 8/1957 | Kelley |
| 2,854,858 | A | 10/1958 | Butterfield |
| 2,867,136 | A | 1/1959 | Albinson |
| 2,883,876 | A | 4/1959 | Taylor |
| 3,019,671 | A | 2/1962 | Albinson |
| 3,025,822 | A | 3/1962 | Tenney |
| 3,164,034 | A | 1/1965 | Kelley |
| 3,261,591 | A | 7/1966 | Campbell |
| 3,392,603 | A | 7/1968 | Sanders |
| 3,395,893 | A | 8/1968 | Kumpf |
| 3,680,409 | A | 8/1972 | Chamberlain |

(Continued)

OTHER PUBLICATIONS

Unpublished U.S. Appl. No. 14/585,872, filed Dec. 30, 2014.

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

An outboard motor comprises an engine; an input driveshaft that is caused to rotate by the engine; an output driveshaft that extends parallel to and is laterally spaced apart from the input driveshaft; and a transmission that operatively connects the input driveshaft to the output driveshaft such that rotation of the input driveshaft causes rotation of the output driveshaft. The transmission is positionable into a forward gear in which forward rotation of the input driveshaft causes forward rotation of the output driveshaft, a reverse gear in which forward rotation of the input driveshaft causes reverse rotation of the output driveshaft, and neutral wherein forward rotation of the driveshaft does not cause rotation of the output driveshaft.

20 Claims, 8 Drawing Sheets

(56) References Cited

U.S. PATENT DOCUMENTS 3,831,401 A 8/1974 Hurwitz
3,977,503 A 8/1976 Hurst
3,994,254 A 11/1976 Woodfill
4,022,308 A 5/1977 Hurst
4,058,189 A 11/1977 Chamberlain
4,504,238 A 3/1985 Neisen
4,820,209 A 4/1989 Newman
4,850,911 A 7/1989 Nakahama
4,919,009 A 4/1990 Newman
5,018,996 A 5/1991 Newman et al.
5,154,654 A * 10/1992 Yamazaki ..... B63H 20/245 440/88 R
5,190,488 A * 3/1993 Fujimoto ..... B63H 20/08 440/53
5,564,992 A 10/1996 Cunningham
6,053,834 A 4/2000 Savoyard
6,062,926 A 5/2000 Alexander, Jr. et al.
6,146,223 A 11/2000 Karls et al.
6,346,017 B1 2/2002 Silorey
6,497,594 B1 12/2002 Towner
6,755,703 B1 6/2004 Erickson
7,010,911 B2 3/2006 Morise
7,131,386 B1 11/2006 Caldwell
7,387,556 B1 6/2008 Davis
7,458,866 B2 12/2008 Nakamura
7,485,020 B2 2/2009 Nakamura
7,544,110 B1 6/2009 Phillips et al.
7,632,161 B1 12/2009 Waldvogel et al.
7,997,398 B1 8/2011 Phillips et al.
8,298,025 B2 10/2012 Eichinger
8,460,041 B2 * 6/2013 Davis ..... B63H 20/14 440/75
9,441,724 B1 9/2016 Pugh
9,676,463 B1 6/2017 Fortl
9,759,321 B1 * 9/2017 Fortl ..... F16H 63/3003
9,840,316 B1 * 12/2017 Jaszewski ..... B63H 20/20
9,896,172 B1 2/2018 Pugh
9,919,783 B1 * 3/2018 Tuchscherer ..... B63H 20/20
9,964,210 B1 * 5/2018 Jaszewski ..... F16H 63/3003
2004/0035232 A1 2/2004 Plews
2006/0016034 A1 6/2006 Nakamura
2006/0116034 A1 6/2006 Nakamura
2008/0096713 A1 4/2008 Beson
2013/0267133 A1 10/2013 Davis et al.
2013/0267134 A1 10/2013 Davis et al.
2013/0273792 A1 * 10/2013 Davis ..... B63H 20/14 440/75
2014/0038478 A1 2/2014 Foreman
2014/0259896 A1 9/2014 Davis
2015/0013486 A1 * 1/2015 Kubo ..... B63H 20/14 74/339
2015/0017847 A1 1/2015 Kubo
2015/0367924 A1 12/2015 Davis
2017/0259896 A1 9/2017 Davis

* cited by examiner

OUTBOARD MOTORS HAVING TRANSMISSIONS WITH LATERALLY OFFSET INPUT AND OUTPUT DRIVESHAFTS

FIELD

The present disclosure relates to outboard motors, and more particularly to transmissions for outboard motors.

BACKGROUND

This Background and Summary are provided to introduce a selection of concepts that are further described below in the Detailed Description. The Background and Summary are not intended to identify key or essential features of the claimed subject matter, nor are they intended to be used as an aid in limiting the scope of the claimed subject matter.

The following U.S. Patents and Application are incorporated herein by reference:

U.S. Pat. No. 3,994,254 discloses a multiple-speed transmission for coupling an engine to the impeller of a marine jet drive, such that an overdrive connection powers the jet drive under operating conditions up to a predetermined upper limit of cruising speeds and such that a reduced drive, for example a direct-drive connection, is automatically established for jet-drive speeds in excess of the cruising conditions.

U.S. Pat. No. 5,018,996 discloses a fluid coupling transmission adapted for interposition between the engine and the propulsion unit of a marine drive. The fluid coupling transmission provides variable speed operation in both forward and reverse. A fluid pump is drivingly connected to the engine crankshaft, and is adapted to drive a turbine. A series of variable position vanes are disposed between the fluid pump and turbine at the entrance of fluid into the pump, for controlling the power transfer there between by controlling the amount of fluid passing through the pump and acting on the turbine. A ring gear is connected to the turbine, and a sun gear is connected to the output shaft of the transmission. One or more planet gears are provided between the ring gear and the sun gear, and are rotatably mounted to a carrier member, which extends coaxially with respect to the output shaft. An output control mechanism, including a brake band and a plate clutch mechanism, is selectively engageable with the carrier member so as to control the direction of rotation of the transmission output shaft.

U.S. Pat. No. 6,755,703 discloses a hydraulic assist mechanism for use in conjunction with a gear shift device that provides a hydraulic cylinder and piston combination connected by a linkage to a gear shift mechanism. Hydraulic pressure can be provided by a pump used in association with either a power trim system or a power steering system. Hydraulic valves are used to pressurize selected regions of the hydraulic cylinder in order to actuate a piston which is connected, by an actuator, to the gear shift mechanism.

U.S. Pat. No. 7,544,110 discloses an actuator for a marine transmission that uses four cavities of preselected size in order to provide four potential forces resulting from pressurized hydraulic fluid within those cavities. The effective areas of surfaces acted upon by the hydraulic pressure are selected in order to provide increased force to move the actuator toward a neutral position from either a forward or reverse gear position. Also, the relative magnitudes of these effective areas are also selected to provide a quicker movement into gear than out of gear, given a similar differential magnitude of pressures within the cavities.

U.S. Pat. No. 9,441,724 discloses a method of monitoring and controlling a transmission in a marine propulsion device that comprises the steps of receiving a rotational input speed of an input shaft to the transmission, receiving a rotational output speed of an output shaft from the transmission, receiving a shift actuator position value, and receiving an engine torque value. The method further comprises calculating a speed differential based on the input speed and the output speed, and generating a slip profile based on a range of speed differentials, engine torque values, and shift actuator position values.

U.S. patent application Ser. No. 14/585,872 discloses a transmission for a marine propulsion device having an internal combustion engine that drives a propulsor for propelling a marine vessel in water. An input shaft is driven into rotation by the engine. An output shaft drives the propulsor into rotation. A forward planetary gearset that connects the input shaft to the output shaft so as to drive the output shaft into forward rotation. A reverse planetary gearset that connects the input shaft to the output shaft so as to drive the output shaft into reverse rotation. A forward brake engages the forward planetary gearset in a forward gear wherein the forward planetary gearset drives the output shaft into the forward rotation. A reverse brake engages the reverse planetary gearset in a reverse gear wherein the reverse planetary gearset drives the output shaft into the reverse rotation.

SUMMARY

An outboard motor comprises an engine, an input driveshaft that is caused to rotate by the engine, an output driveshaft that extends parallel to and is laterally spaced apart from the input driveshaft, and a transmission that operatively connects the input driveshaft to the output driveshaft such that rotation of the input driveshaft causes rotation of the output driveshaft. The transmission is positionable into a forward gear in which forward rotation of the input driveshaft causes forward rotation of the output driveshaft, a reverse gear in which forward rotation of the input driveshaft causes reverse rotation of the output driveshaft, and neutral wherein forward rotation of the driveshaft does not cause rotation of the output driveshaft. A propulsor shaft transversely extends relative to the output driveshaft. A beveled gearset operatively couples the output driveshaft to the propulsor shaft so that rotation of the output driveshaft causes rotation of the propulsor shaft. Various other features, objects and advantages of the disclosure will be made apparent from the following description taken together with the drawings.

BRIEF DESCRIPTION OF THE DRAWINGS

The drawings illustrate the best mode presently contemplated of carrying out the concepts of the present disclosure. The same numbers are used throughout the drawings to reference like features and like components. In the drawings.

DETAILED DESCRIPTION OF THE DRAWINGS

Figure 1:
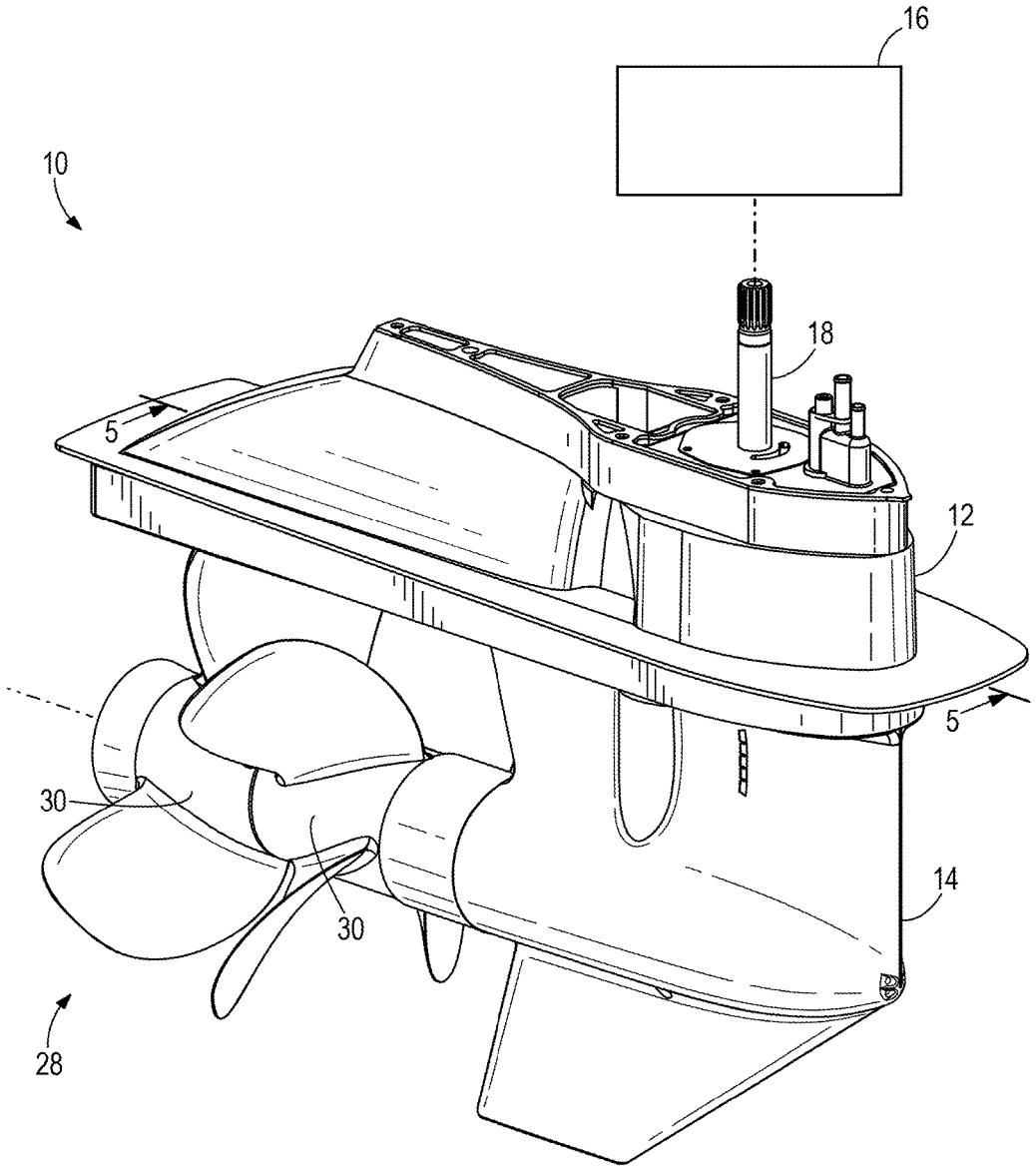
FIG. 1 is a perspective view of a lower gearcase on an outboard motor.
Figure 2:
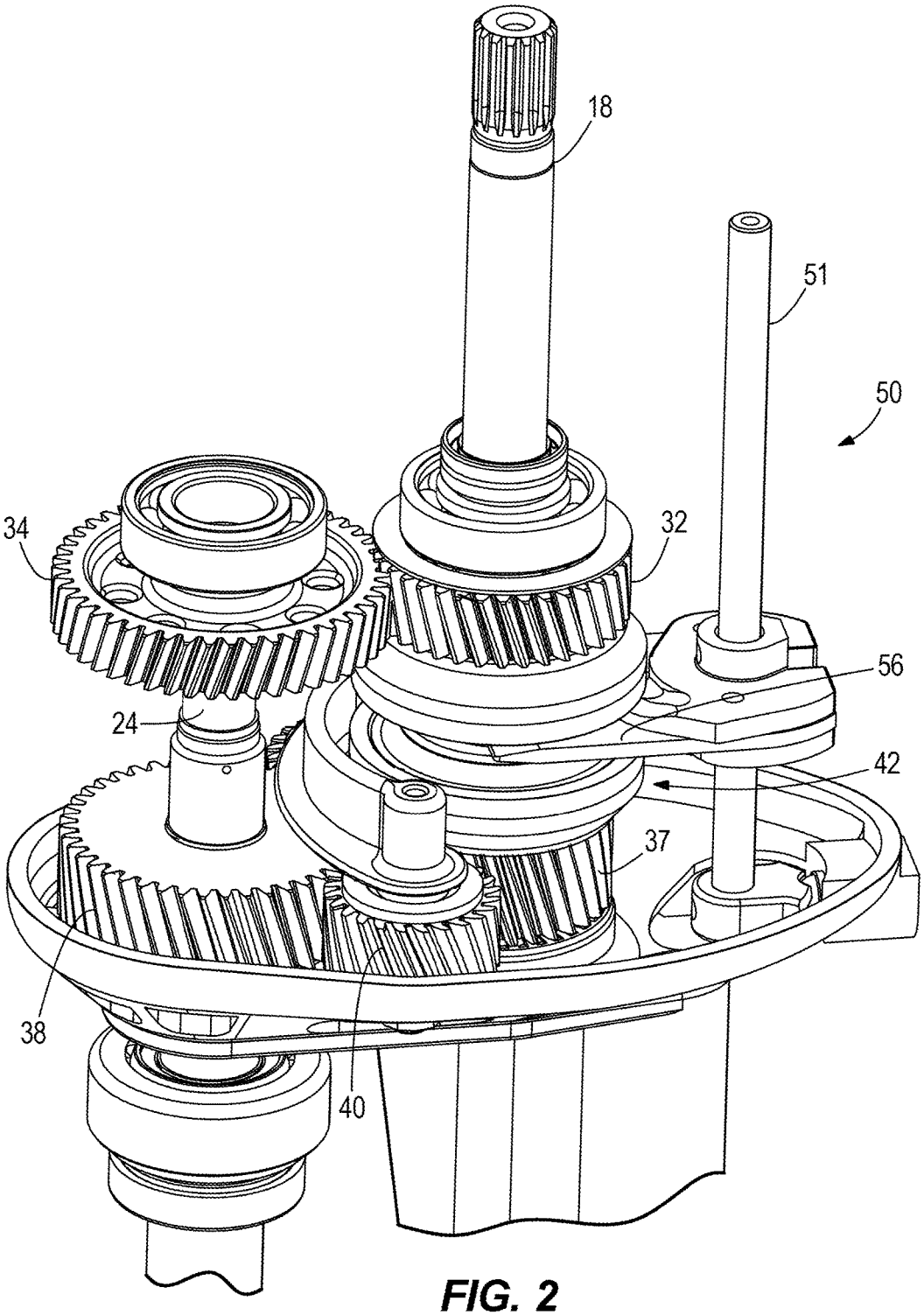
FIG. 2 is a perspective view looking downward at a transmission for the outboard motor.
Figure 3:
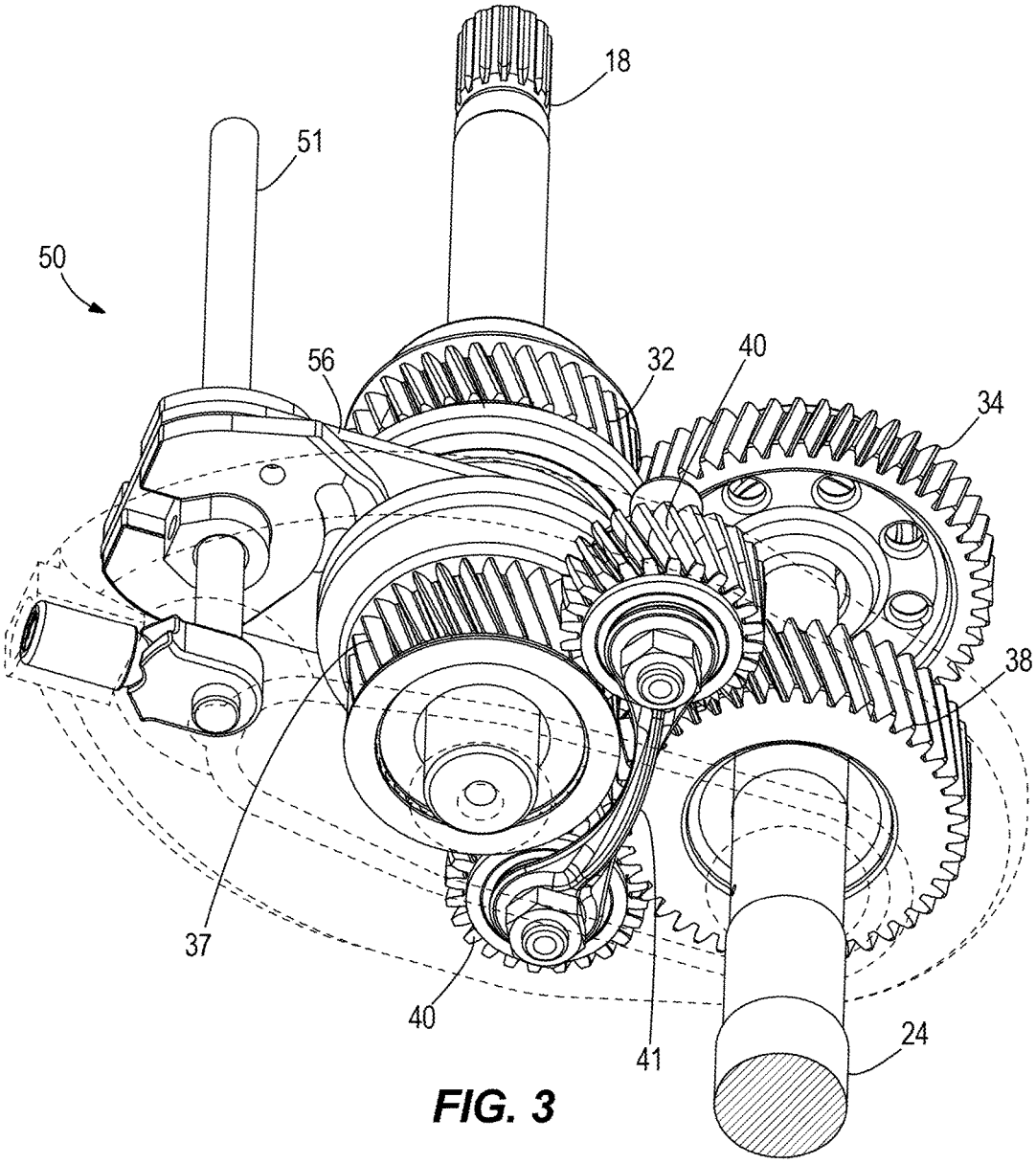
FIG. 3 is a perspective view looking upward at the transmission.
Figure 4:
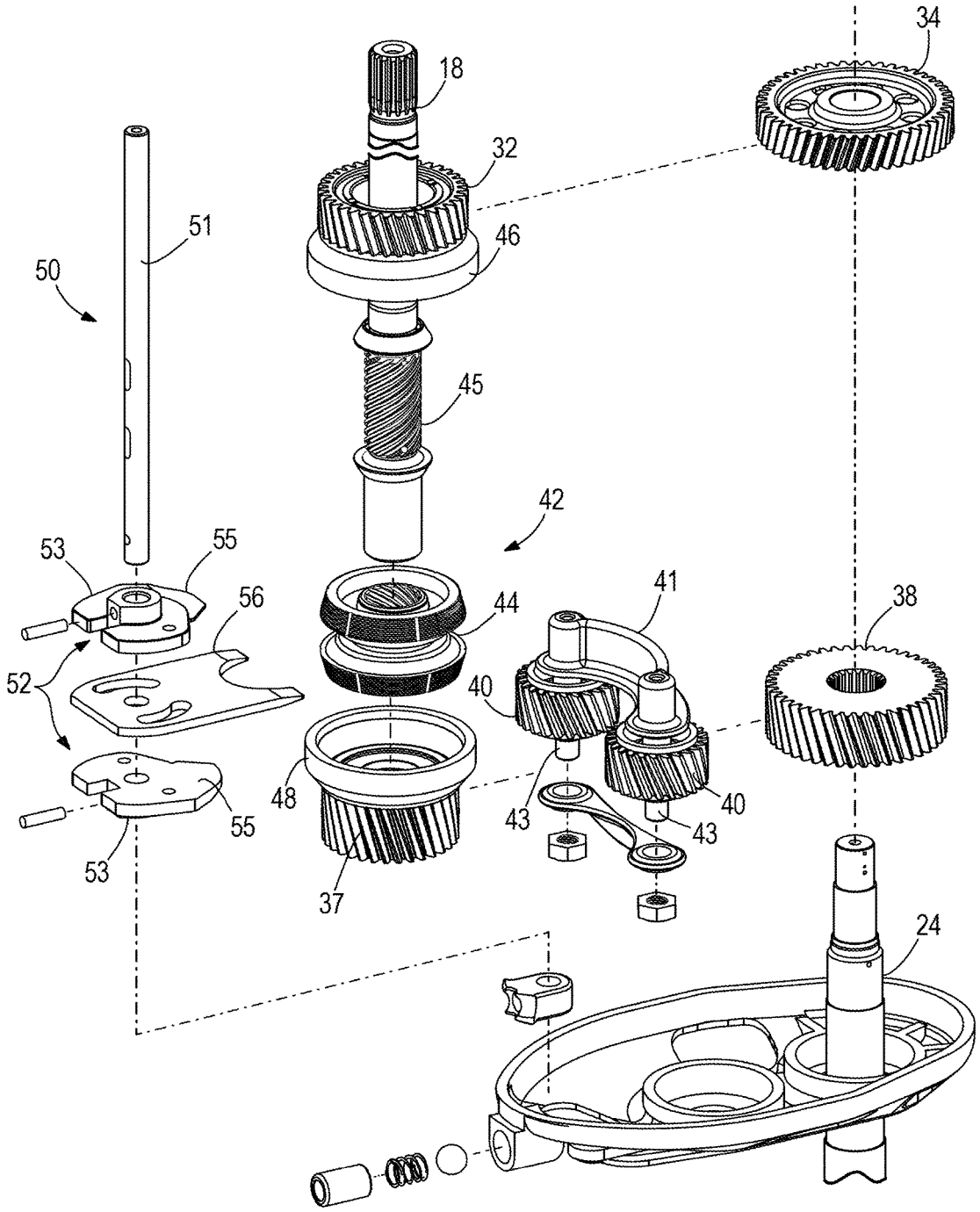
FIG. 4 is an exploded view of the transmission.

During research and development of outboard motors, the present inventors have determined that dual propeller outboard motors offer several performance improvements over single propeller motors. However it can be difficult to design a dual propeller outboard motor that meets all performance goals and has little detrimental impact to the overall design of the outboard motor. Typical outboard motors transfer power through a driveshaft from a powerhead to a right angle gearset (i.e. a pinion with forward and reverse gears) that turns a propeller shaft. Shifting is typically accomplished with a clutching system, typically a dog clutch, which is moved from one gear to the other depending on the user's command. Through research and development, the present inventors have invented a transmission assembly for an outboard motor that allows use of several different types of clutching systems and adds an additional gear set and pressure lubrication to utilize dual counter rotating propellers within a traditional outboard motor structure. The transmission apparatuses disclosed herein provide simple direct mechanical activation of a shifting mechanism, to thereby provide a durable system for consistent performance. Dual parallel driveshafts allow for utilization of a simple gearset to provide the proper total output ratio. Several different clutching options provide function within a minimum package size. Dual floating idler gears provide power transfer within a minimum package size. A lubrication circuit provides lubrication where needed. A replaceable filter provides protection from debris in the system.

FIGS. 1-8 depict portions of an outboard motor 10 according to the present disclosure. The outboard motor 10 includes a transmission housing 12 and a lower gearcase housing 14, which are located below a (not shown) driveshaft housing of the outboard motor 10. The outboard motor 10 includes an internal combustion engine, shown schematically at 16 in FIG. 1. As is conventional, the internal combustion engine 16 is configured to cause rotation of an input driveshaft 18 that extends along an input driveshaft axis 20 into the transmission housing 12.

Referring to FIGS. 2-7, a transmission 22 operatively connects the input driveshaft 18 to an output driveshaft 24 that extends parallel to and is laterally spaced apart from the input driveshaft 18. As described further herein below, the transmission 22 is positionable into and between a forward gear (FIG. 6) in which forward rotation of the input driveshaft 18 causes forward rotation of the output driveshaft 24, a reverse gear (FIG. 7) in which forward rotation of the input driveshaft 18 causes reverse rotation of the output driveshaft 24, and neutral (FIG. 5) wherein forward rotation of the input driveshaft 18 does not cause rotation of the output driveshaft 24.

Figure 5:
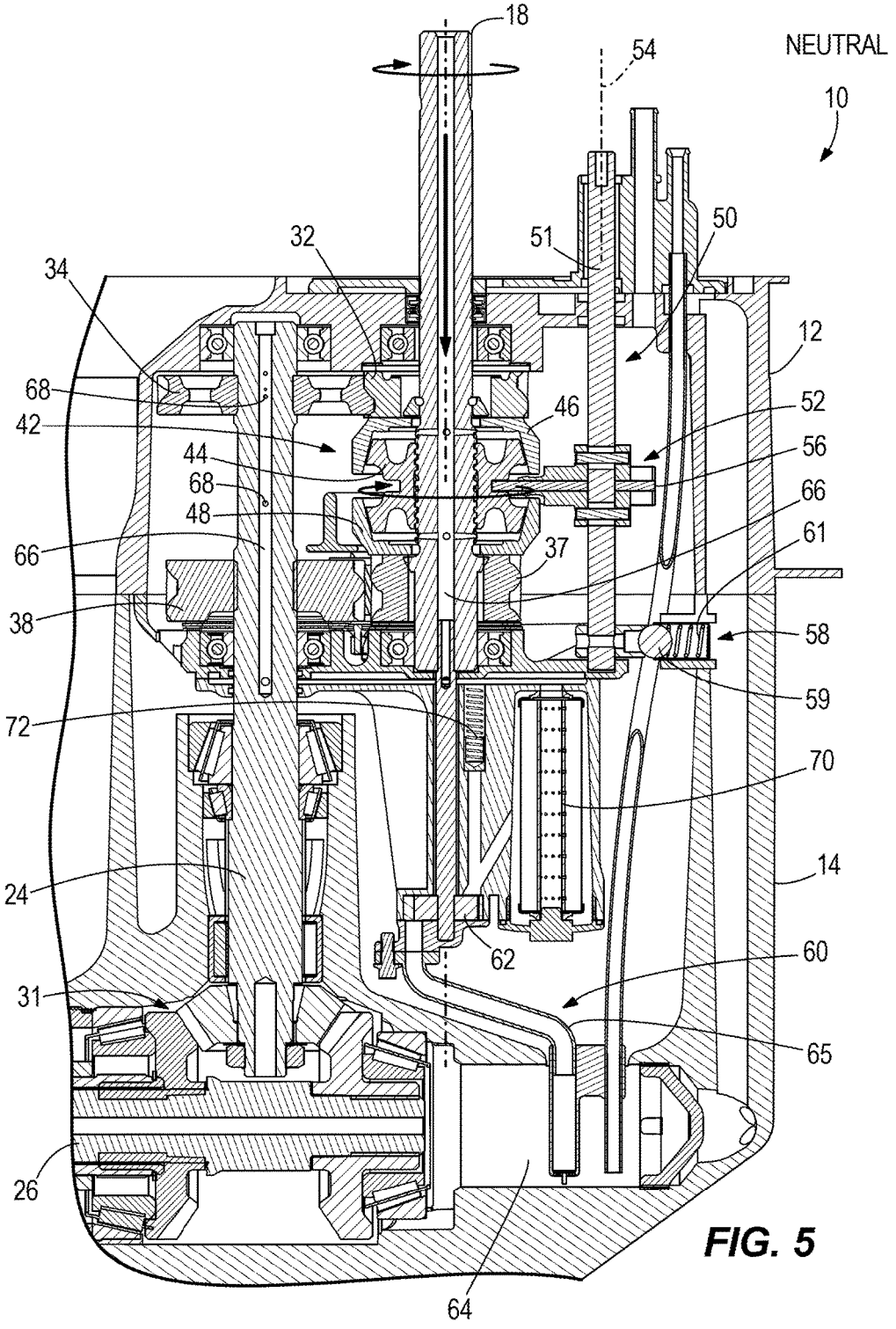
FIGS. 5-7 are view of section 5-5 taken in FIG. 1, showing alternative power flows through the transmission.
Figure 6:
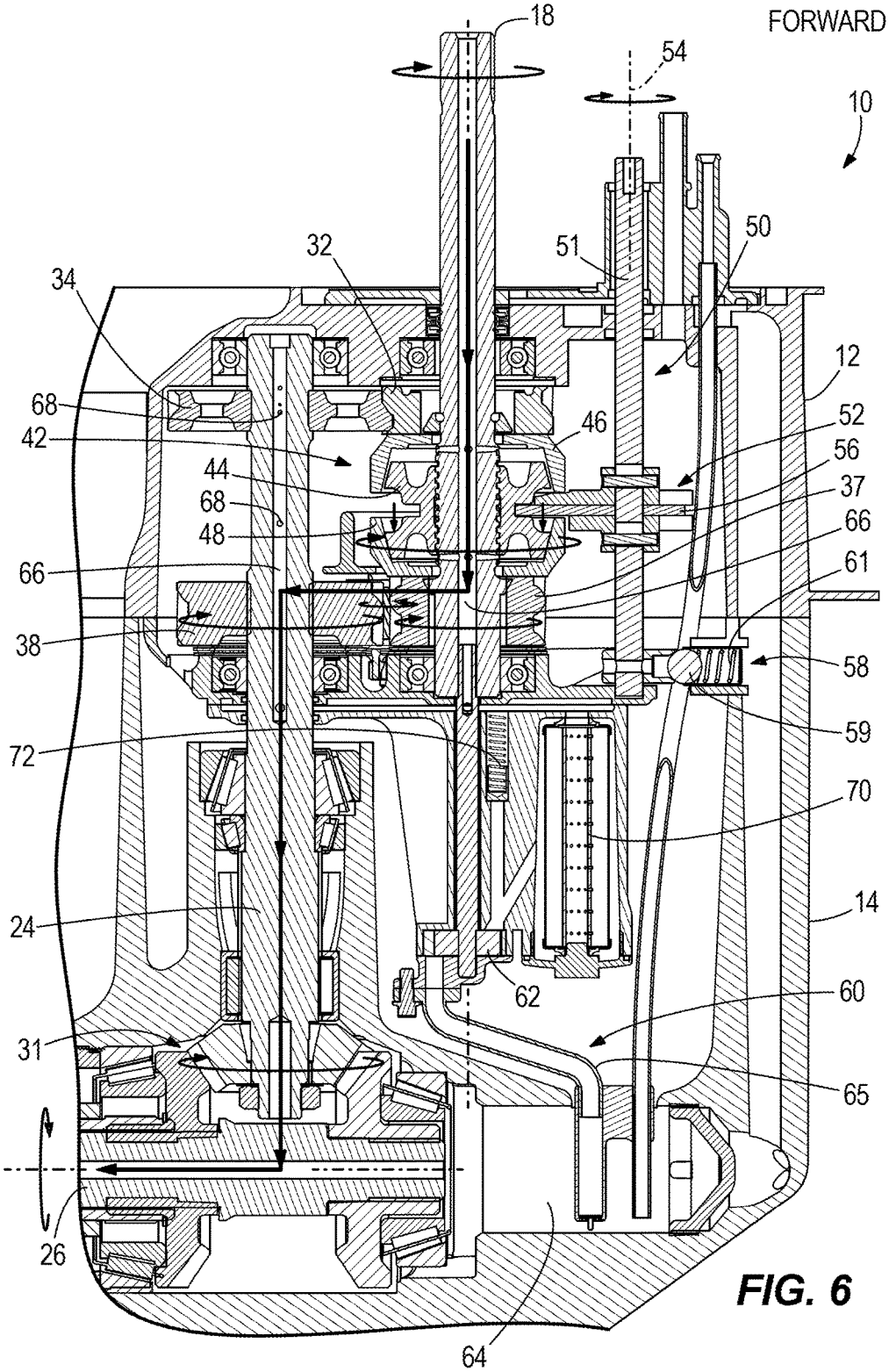
Figure 7:
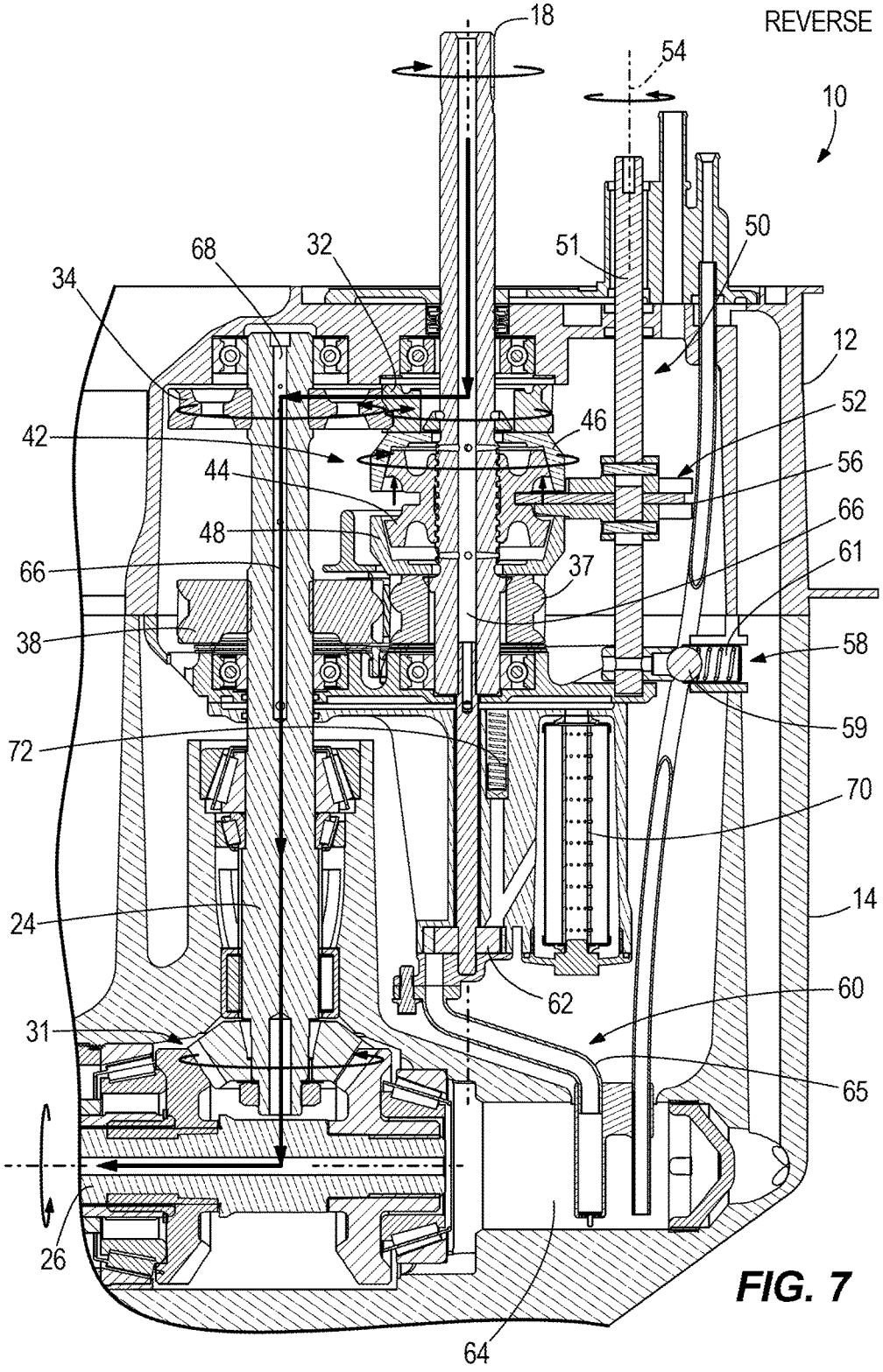
Figure 8:
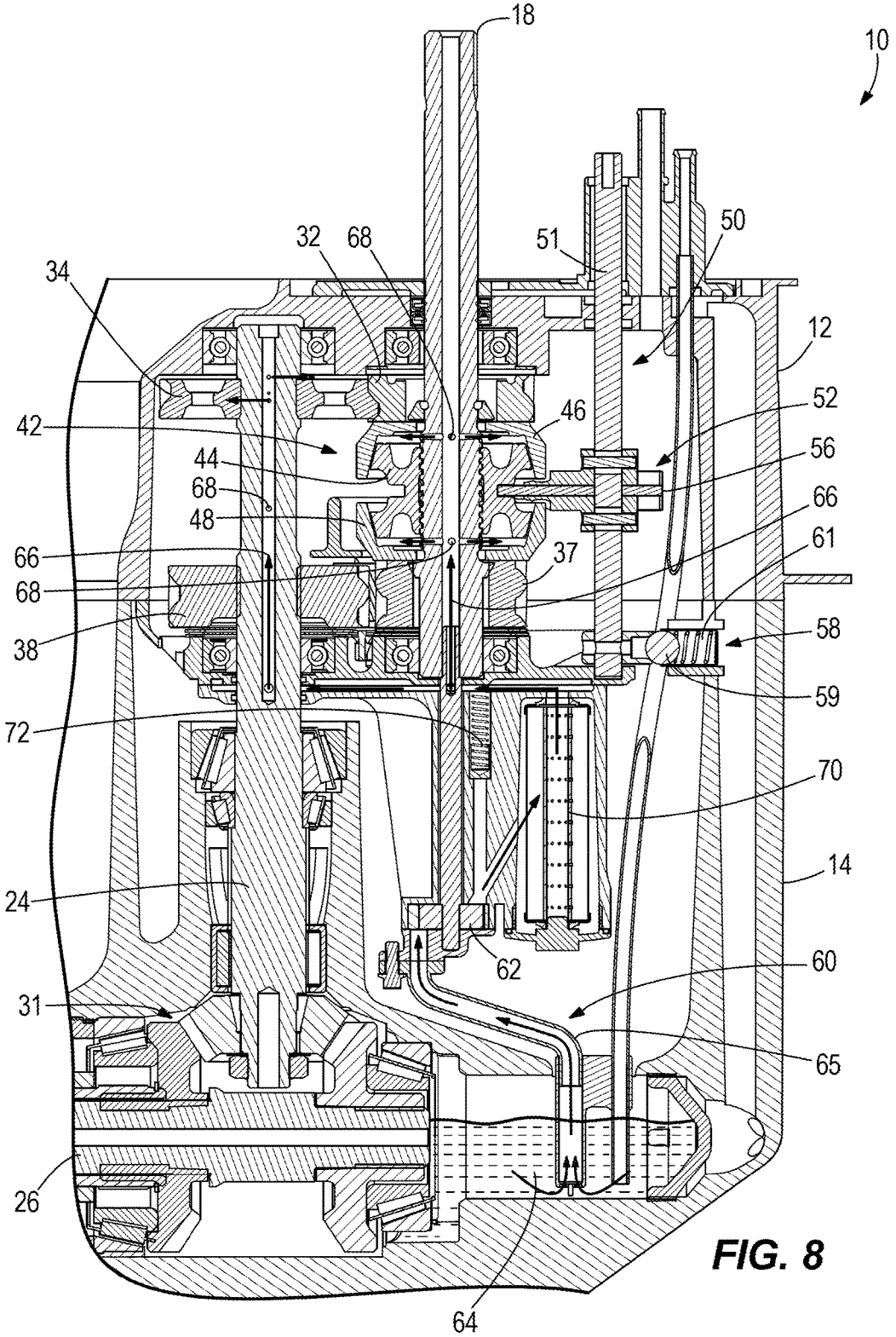
FIG. 8 is a view of section 5-5 taken in FIG. 1, showing a lubrication circuit for the transmission.

Referring to FIGS. 5-7, a propulsor shaft 26 transversely extends relative to the output driveshaft 24. The propulsor shaft 26 is located in the lower gearcase housing 14 and is rotationally connected to a propulsor 28 (see FIG. 1) which rotates with the propulsor shaft 26. In the illustrated example, the propulsor 28 includes a pair of counter rotating propellers 30 that are configured to interact with the surrounding body of water to propel the marine vessel to which the outboard motor 10 is attached. The type and configuration of the propulsor 28 can vary from that which shown and for example can include different propeller configurations, impellers, and/or the like. A conventional beveled gearset 31 (see FIGS. 5-8) operatively couples the output driveshaft 24 to the propulsor shaft 26 so that rotation of the output driveshaft 24 causes corresponding rotation of the propulsor shaft 26.

Referring to FIGS. 2-7, the transmission 22 includes a reverse driving gear 32 on the input driveshaft 18 and a reverse driven gear 34 on the output driveshaft 24. The reverse driving rear 32 is rotatably fixed to the input driveshaft 18 and the reverse driven gear 34 is rotatably fixed to the output driveshaft 24. The reverse driving gear 32 and reverse driven gear 34 are meshed together such that forward rotation of the input driveshaft 18 causes forward rotation of the reverse driving gear 32, which thereby causes reverse rotation of the reverse driven gear 34. Reverse rotation of the reverse driven gear 34 causes reverse rotation of the output driveshaft 24. Reverse rotation of the output driveshaft 24 causes reverse rotation of the propulsor shaft 26, via the beveled gearset 31. Reverse rotation of the propulsor shaft 26 causes the propulsor 28 to rotate so that a reverse thrust is imparted on the marine vessel.

The transmission 22 also includes a forward driving gear 37 on the input driveshaft 18, a forward driven gear 38 on the output driveshaft 24, and a pair of idler gears 40 that is meshed between so as to connect the forward driving gear 36 and the forward driven gear 38. The pair of idler gears 40 is supported by a floating idler gear mounting bracket 41 carrying pivot axles 43 about which the pair of idler gears 40 rotates. The forward driving gear 37 is rotatably fixed to the input driveshaft 18 and the forward driven gear 38 is rotatably fixed to the output driveshaft 24. Forward rotation of the input driveshaft 18 causes forward rotation of the forward driving gear 36, which causes reverse rotation of the pair of idler gears 40, which causes forward rotation of the forward driven gear 38. Forward rotation of the forward driven gear 38 causes forward rotation of the output driveshaft 24. Forward rotation of the output driveshaft 24 causes forward rotation of the propulsor shaft 26 via the beveled gearset 31, which causes the propulsor 28 to rotate so that a forward thrust is imparted on the marine vessel.

In the illustrated embodiment, a cone clutch 42 is operable to position the transmission 22 into and between the above-described forward gear in which forward rotation of the input driveshaft 18 causes forward rotation of the propulsor shaft 26, reverse gear in which forward rotation of the input driveshaft 18 causes reverse rotation of the propulsor shaft 26, and neutral in which forward rotation of the input driveshaft 18 does not cause forward or reverse rotation of the propulsor shaft 26. The type and configuration of clutch can vary from that which is shown. In the illustrated example, the cone clutch 42 has a central cone 44 that is coupled to the input driveshaft 18, for example via helical or axial splines 45, so that rotation of the input driveshaft 18 causes rotation of the central cone 44 in each of the noted forward gear, reverse gear and neutral. The central cone 44 is axially movable, e.g., slideable, along the input driveshaft 18 into and between a reverse position (FIG. 7) in which the central cone 44 enacts the reverse gear, a forward position (FIG. 6) in which the central cone 44 enacts the forward gear, and a neutral position (FIG. 5), in which the central cone 44 enacts neutral. In other examples, the clutch can include a mechanical actuated wet plate clutch, an electro actuated wet plate clutch, a dog clutch, and/or the like.

The cone clutch 42 includes a reverse cone 46 that is fixed to the reverse driving gear 32. When the transmission 20 is engaged in the noted reverse gear, the central cone 44 engages the reverse cone 46 so that rotation of the central cone 44 causes rotation of the reverse cone 46 and thus rotation of the reverse driving gear 32. The cone clutch 42 further includes a forward cone 48 that is fixed to the forward driving gear 36. When the transmission 20 is engaged in the noted forward gear, the central cone 44 engages the forward cone 48 so that rotation of the central cone 44 causes rotation of the forward cone 48 and thus rotation of the forward driving gear 36.

A shift actuator 50 is configured to axially move the central cone 44 along the input driveshaft 18 so as to enact the noted reverse, neutral and forward gears. The shift actuator 50 includes a shift shaft 51 and a camming mechanism 52 that cams the shift shaft 51 up and down with respect to a shift shaft axis 54 upon rotation of the shift shaft 50 in opposite directions about the shift actuator axis 54. The camming mechanism 52 includes shifter plates 53, each having a contoured camming surface 55. Rotation of the shifter plates 53 with respect to the shift shaft axis 54 causes the contoured camming surfaces 55 to engage the reverse or forward cone 46, 48 and thus causes the camming mechanism 52 and shift shaft 51, to raise or lower depending on the direction of rotation. A shift fork 56 is sandwiched between the shifter plates 53 and travels with the shifter plates 53 along the shift shaft axis 54. The shift fork 56 connects the shift actuator 50 to the central cone 44 such that movement of the shift actuator 50 up and down causes commensurate movement of the central cone 44 up and down along the input driveshaft 18 into the reverse and forward gear positions described herein above.

A detent mechanism 58 detents the shift actuator 50 in its neutral position along the shift actuator axis 54. The detent mechanism 58 includes a ball 59 that is biased into engagement with the shift shaft 51 by a spring 61 when the shift shaft 51 is located in neutral. Rotation of the shift shaft 51 about the shift shaft axis 54 causes the camming mechanism 52 to overcome the bias of the spring 61 and allows the shift shaft 51 to move out of the neutral position. Opposite rotation of the shift shaft 51 about the shift shaft axis 54 causes the camming mechanism 52 to bring the shift shaft 51 back into the neutral position wherein the spring 61 biases the ball 59 back into engagement with the shift shaft 51 to retain the shift shaft 51 in the neutral position.

In operation, rotation of the shift shaft 51 rotates the camming mechanism 52, as described above, to thereby raise or lower the shift fork 56 depending on the direction of rotation. The shift fork 56 carries the cone clutch 42 up or down on the input driveshaft 18, to thereby enact the above-described reverse gear, forward gear, and neutral Referring to FIG. 8, a lubrication circuit 60 provides lubrication to the transmission 22. A lubrication pump 62 (for example a Gerotor) is coupled to the input driveshaft 18. Rotation of the input driveshaft 18 causes the lubrication pump 62 to pump the lubrication through the lubrication circuit 60. A lubrication reservoir 64 is located in the lower gearcase housing 14. The lubrication pump 62 draws lubrication from the lubrication reservoir 64 through a conduit 65 having a filtering screen, and pumps the lubrication to the transmission 22, specifically via axial channels 66 and a plurality of transverse openings 68 in the input driveshaft 18 and output driveshaft 24. Via the transverse openings 68, the lubrication is sprayed onto the surfaces of the cone clutch 42 requiring lubrication. The lubrication drains by gravity through the transmission 22, back to the lubrication reservoir 64. A replaceable filter 70 is disposed in the lubrication circuit 60. The lubrication pump 62 is configured to pump the lubrication through the replaceable filter 70 and then to the transmission 22 via the axial channels 66 and transverse openings 68. A spring-actuated bypass check valve 72 opens under pressure from the lubrication when the replaceable filter 70 becomes plugged and allows flow of lubrication to bypass the filter 70 on its way to the transmission 22.

This written description uses examples to disclose embodiments of a marine propulsion device, including the best mode, and also to enable any person skilled in the art to make and use the same. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An outboard motor comprising:

an engine;

an input driveshaft that is caused to rotate by the engine;

an output driveshaft that extends parallel to and is laterally spaced apart from the input driveshaft;

a transmission that operatively connects the input driveshaft to the output driveshaft such that rotation of the input driveshaft causes rotation of the output driveshaft, wherein the transmission is positionable into and between a forward gear in which forward rotation of the input driveshaft causes forward rotation of the output driveshaft, a reverse gear in which forward rotation of the input driveshaft causes reverse rotation of the output driveshaft, and neutral wherein forward rotation of the input driveshaft does not cause rotation of the output driveshaft; and a propulsor shaft that transversely extends relative to the output driveshaft and a beveled gearset that operatively couples the output driveshaft to the propulsor shaft so that rotation of the output driveshaft causes rotation of the propulsor shaft.

2. The outboard motor according to claim 1, wherein the transmission comprises a reverse driving gear on the input driveshaft and a reverse driven gear on the output driveshaft; and wherein in the reverse gear, forward rotation of the input driveshaft causes forward rotation of the reverse driving gear, which causes reverse rotation of the reverse driven gear, which causes reverse rotation of the output driveshaft.

3. The outboard motor according to claim 2, wherein the transmission comprises a forward driving gear on the input driveshaft, a forward driven gear on the output driveshaft, and an idler gear meshed between the forward driving gear and the forward driven gear, wherein in forward gear, forward rotation of the input driveshaft causes forward rotation of the forward driving gear, which causes reverse rotation of the idler gear, which causes forward rotation of the forward driven gear, which causes forward rotation of the output driveshaft.

4. The outboard motor according to claim 3, wherein the transmission comprises a cone clutch that is operable to position the transmission into the forward gear, reverse gear and neutral.

5. The outboard motor according to claim 4, wherein the cone clutch comprises a central cone that is coupled to the input driveshaft so that rotation of the input driveshaft causes rotation of the central cone in each of the forward gear, reverse gear, and neutral, wherein the central cone is positionable along the input driveshaft into and between a reverse position in which the central cone enacts the reverse gear, a forward position in which the central cone enacts the forward gear and a neutral position in which the central cone enacts neutral.

6. The outboard motor according to claim 5, wherein the cone clutch further comprises a reverse cone fixed to the reverse driving gear, wherein in the reverse gear, the central cone engages the reverse cone so that rotation of the central cone causes rotation of the reverse cone and thus the reverse driving gear.

7. The outboard motor according to claim 6, wherein the cone clutch further comprises a forward cone fixed to the forward driving gear, wherein in the forward gear, the central cone engages the forward cone so that rotation of the central cone causes rotation of the forward cone and thus the forward driving gear.

8. The outboard motor according to claim 7, further comprising a shift actuator that is configured to move the central cone along the input driveshaft so as to enact the reverse, neutral and forward gears.

9. The outboard motor according to claim 8, further comprising a detent mechanism that detents the shift actuator in neutral position.

10. The outboard motor according to claim 9, wherein the detent mechanism is spring actuated.

11. The outboard motor according to claim 8, further comprising a camming mechanism that cams the shift actuator up and down upon rotation of the shift actuator back and forth, wherein movement of the shift actuator up and down causes movement of the central cone up and down, respectively.

12. The outboard motor according to claim 1, further comprising a lubrication circuit that provides lubrication to the transmission.

13. The outboard motor according to claim 12, further comprising a lubrication pump coupled to the input driveshaft such that rotation of the input driveshaft causes the lubrication pump to pump lubrication through the lubrication circuit.

14. The outboard motor according to claim 13, further comprising a lower gearcase that encases the beveled gearset, wherein the lubrication circuit comprises a lubrication reservoir in the lower gearcase, wherein the lubrication pump draws lubrication from the lubrication reservoir and pumps the lubrication to the transmission.

15. The outboard motor according to claim 14, wherein the lubrication pump pumps the lubrication to the transmission via an axial channel and a plurality of transverse openings in the input driveshaft.

16. The outboard motor according to claim 15, further comprising a replaceable filter in the lubrication circuit, wherein the lubrication pump pumps the lubrication through the replaceable filter and then to the transmission via the axial channel and plurality of transverse openings.

17. The outboard motor according to claim 16, further comprising a check valve that opens under pressure from the lubrication when the replaceable filter becomes plugged.

18. The outboard motor according to claim 1, further comprising a propulsor that rotates with the propulsor shaft.

19. The outboard motor according to claim 8, wherein the propulsor comprises a pair of counter rotating propulsors that are driven by the propulsor shaft.

20. An outboard motor comprising:

an engine;

an input driveshaft that is caused to rotate by the engine;

an output driveshaft that extends parallel to and is laterally spaced apart from the input driveshaft;

a transmission that operatively connects the input driveshaft to the output driveshaft such that rotation of the input driveshaft causes rotation of the output driveshaft, wherein the transmission is positionable into a forward gear in which forward rotation of the input driveshaft causes forward rotation of the output driveshaft, a reverse gear in which forward rotation of the input driveshaft causes reverse rotation of the output driveshaft, and neutral wherein forward rotation of the driveshaft does not cause rotation of the output driveshaft;

a propulsor shaft that transversely extends relative to the output driveshaft;

a beveled gearset that operatively couples the output driveshaft to the propulsor shaft so that rotation of the output driveshaft causes rotation of the propulsor shaft;

wherein the transmission comprises a reverse driving gear on the input driveshaft and a reverse driven gear on the output driveshaft; and wherein in the reverse gear, forward rotation of the input driveshaft causes forward rotation of the reverse driving gear, which causes reverse rotation of the reverse driven gear, which causes reverse rotation of the output driveshaft;

wherein the transmission comprises a forward driving gear on the input driveshaft, a forward driven gear on the output driveshaft, and an idler gear meshed between the forward driving gear and the forward driven gear, wherein in forward gear, forward rotation of the driveshaft causes forward rotation of the forward driving gear, which causes reverse rotation of the idler gear, which causes forward rotation of the forward driven gear, which causes forward rotation of the output driveshaft;

wherein the transmission comprises a cone clutch that is operable to position the transmission into the forward gear, reverse gear and neutral;

a lubrication circuit that provides lubrication to the transmission;

a lubrication pump coupled to the input driveshaft such that rotation of the input driveshaft causes the lubrication pump to pump lubrication through the lubrication circuit; and a lower gearcase that encases the beveled gearset, wherein the lubrication circuit comprises a lubrication reservoir in the lower gearcase, wherein the lubrication pump draws lubrication from the lubrication reservoir and pumps the lubrication to the transmission.

* * * * *